United States Patent [19]

Paton et al.

[11] 4,297,665

[45] Oct. 27, 1981

[54] DOUGHNUT-TYPE TRANSFORMER FOR RESISTANCE BUTT WELDING

[76] Inventors: Boris E. Paton, ulitsa Chkalova, 41-a, kv. 26; Vladimir K. Lebedev, ulitsa Engelsa, 25, kv. 12; Sergei I. Kuchuk-Yatsenko, ulitsa Filatova, 1/22, kv. 47; Vasily A. Sakharnov, ulitsa Solomenskaya, 41, kv. 93; Boris A. Galyan, ulitsa Lenina, 88/92, kv. 110; Stanislav D. Dobrovolsky, ulitsa Zhukova, 22, kv. 7, all of Kiev, U.S.S.R.

[21] Appl. No.: 149,734

[22] Filed: May 14, 1980

[30] Foreign Application Priority Data

Aug. 6, 1979 [SU] U.S.S.R. ..... 2789203

[51] Int. Cl.[3] ..... H01F 27/08; H01F 27/28

[52] U.S. Cl. ..... 336/60; 336/183; 336/223; 336/229

[58] Field of Search ..... 336/60, 223, 183, 229, 336/221, 210, 211

[56] References Cited

U.S. PATENT DOCUMENTS 1,831,587 11/1931 Bohraus ..... 336/229 X

*Primary Examiner*—Thomas J. Kozma

*Attorney, Agent, or Firm*—Lackenbach, Lilling & Siegel

[57] ABSTRACT

The doughnut-type transformer comprises a spirally wound core consisting of several individual annular cores each tightened by rod members. The annular core is surrounded by transformer sections comprising the primary and the secondary windings. Each winding is composed of turns shaped as sectors in the plane of the transformer cross-section, a cooled turn of the secondary winding being placed between the turns of the primary winding in each transformer section. The turns of the windings surround the annular core so that the geometric center of each winding is displaced from the geometric center of the annular core in the cross-sectional plane thereof and the geometric center of the annular core is farther from the transformer axis. Each turn of the secondary winding is provided with a passage for cooling water to circulate therethrough, which water being supplied and discharged through one and the same contact ring and is first cooling one half of the whole number of the transformer sections and then the other half.

3 Claims, 4 Drawing Figures

DOUGHNUT-TYPE TRANSFORMER FOR RESISTANCE BUTT WELDING

BACKGROUND OF THE INVENTION

1. Field of the Invention

The present invention relates to welding equipment and more particularly to a doughnut-type transformer for resistance butt welding. Such transformers are utilized in resistance butt welding machines, specifically, for joining pipes.

This invention may prove most advantageous in resistance butt welding machines which are to be arranged within the pipes to be welded, i.e. in the case when a transformer of a specified rating is required to be as small in terms of its weight and dimensions as possible.

2. Description of the Prior Art

Known in the art is a doughnut-type transformer for resistance butt welding (USSR Inventor's Certificate No. 178429, Int. Cl. B 21 k 09/00, 1966), wherein the secondary winding comprises two turns in series, shaped as coaxial cylinders and placed around the core and the primary winding, and thus providing a sealed double-walled frame with a cooling liquid circulating between the walls thereof.

Though offering an improved cooling system this transformer is not deprived of shortcomings which present a problem in application. The problem resides in the fact that the secondary winding in the form of two cylinders has an increased effective resistance as compared with the transformers of a single-turn design. An increase in the effective resistence of the secondary winding of the transformer limits its applicability, i.e. the range of pipe sections for welding gets decreased.

Also known in the art is a transformer for resistance butt welding (USSR Inventor's Certificate No. 93847, Int. Cl. B 23 k 11/24, 1951), comprising an annular core surrounded by transformer sections each having a primary winding and a secondary winding provided with contact shoes. The core is preferably a ring shaped as a regular polygon each side of which is surrounded by the primary winding which is further surrounded by the secondary winding. The prior art transformer may be used in both types of resistance butt welding machines, namely those for operation within the pipes and outside the pipes, as may be required by the terminal design.

The secondary winding of the above transformer may be cooled either naturally or forceably as the case may be, the manner of cooling being effected by means and ways widely known in the art of electrical engineering.

Since the secondary winding of the transformer consists of only one turn, its effective resistance is within the allowable range but in commercial use it presents a problem which is as follows.

Inasmuch as the windings and the core are concentric and the secondary winding is placed around the primary winding, the latter is always shorter than the former.

The effective resistance is therefore increased in the secondary circuit of a welding machine which overheats the transformer.

Furthermore, in the concentric arrangement of the windings the secondary turn is far from the core, which results in power losses.

The fact that the transformer sections are arranged on an annular core having the form of a circle or polygon is the cause of voids not filled with an active material, such as copper or iron. It is only natural that the copper space factor of the transformer is very low.

The problem also resides in that the prior art transformer for use with the welding machines which are to be operated within the pipes to be welded requires a forced cooling system and attempts to provide the same have failed. Should passages (pipe lines) for a cooling medium be provided, while the windings left invariable, then the outer dimensions of the transformer will be greatly increased though limited by the inner diameter of the pipes to be welded. On the other hand, any cavities in a winding to provide cooling and to retain dimensions of the windings will decrease the quantity of the active material (copper) and increase electric resistance of the winding.

This transformer is a sophisticated design to assemble. Difficulties are met with in mounting concentric windings having a large length when assembled, on the annular core.

SUMMARY OF THE INVENTION

An object of the invention is to provide a doughnut-type transformer for resistance butt welding, which is more powerful and smaller in size as compared with the prior art.

Another object of the invention is to provide a doughnut-type transformer for resistance butt welding, offering simpler procedures in manufacture, assembly, and repair.

Yet another object of the invention is to provide a doughnut-type transformer for resistance butt welding, which is more powerful with less power consumed as compared with the prior art.

A further object of the invention is to provide a doughnut-type transformer offering greater unit load on the windings, while having smaller size and weight.

These and other objects of the invention are attained by providing a doughnut-type transformer for resistance butt welding, comprising an annular core surrounded by transformer sections each having a primary winding and cooled secondary winding provided with contact shoes, wherein, according to the invention, the turns of both the primary and the secondary windings are shaped as sectors in the plane of the transformer cross-section, the turns of the primary winding with their lateral sides are near the lateral sides of each turn of the secondary winding, the turns of the windings have openings forming part of an annular space with the annular core extending therethrough, the geometric center of each winding being displaced from the geometric center of the annular core in the cross-sectional plane thereof so that the geometric center of the annular core is farther from the transformer axis to level off current density per winding.

The transformer sections shaped as sectors arranged circumferentially provides for take up of the whole volume within the transformer with electrically active materials. Due to this feature, the transformer has small over-all dimensions and high electrical parameters, namely, high specific power, low electric resistance. The inventive combination makes it possible to mount the transformer on the machine operative inside the pipes to be welded, the pipes of a small diameter (about 520 mm) as well as those of a medium diameter (up to 900 mm).

It is preferred that each turn of the secondary winding be provided with a passage for a cooling agent to circulate therethrough, while the transformer may comprise two contact rings of which one will have two manifold-type passages for connection to a cooling agent supply line and a cooling agent drain line respectively at one side and communicating with the passages in the secondary windings at the other one. Then the other ring will have an annular passage communicating with the passages in the secondary windings so as to supply the cooling agent to a half of the whole number of windings to drain the same from the other half of the windings.

The simultaneous supply of the cooling agent to one half (e.g. upper portion from the diametral plane of section) of the secondary winding and the same simultaneous draining of the cooling agent from the other half (e.g. lower portion from the diametral plane of section) make the design, production, and maintenance simpler.

It is preferred that the annular core be composed of a plurality of individual annular spiral metal bands radially tightened by rod members.

BRIEF DESCRIPTION OF THE DRAWINGS

Now the invention will be understood from the following detailed description thereof and the accompanying drawings illustrating a doughnut-type transformer for resistance butt welding, in which similar parts are identified by similar reference numerals and in which.

DESCRIPTION OF THE PREFERRED EMBODIMENT

Figure 1:
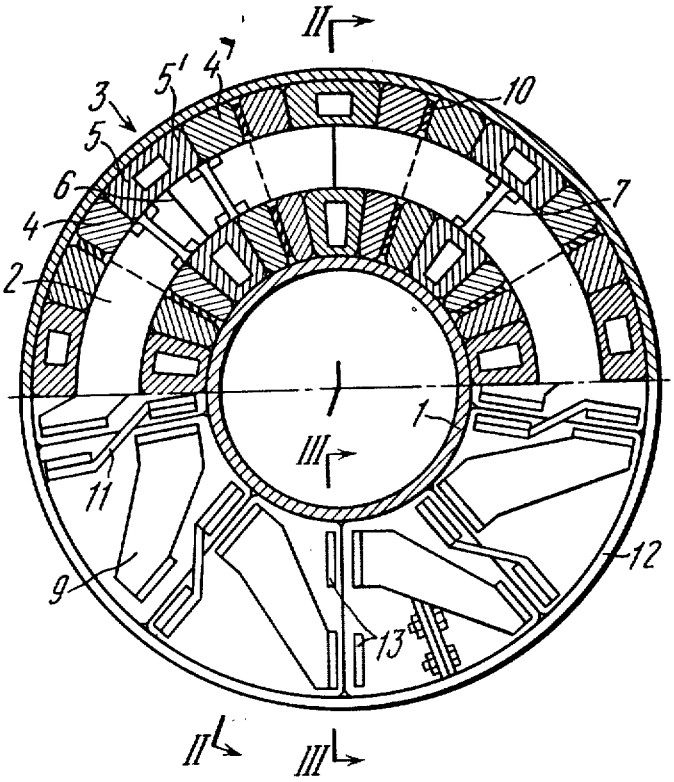
FIG. 1 is a diagrammatic representation in cross-section of a doughnut-type transformer for resistance butt welding according to the invention.

For use with the welding machines operable inside the pipes to be welded the transformer of the invention is usually mounted on a centrally disposed tubular stem 1, FIG. 1, which supports the welding machine assembly. Now the invention will be described by way of this specific example.

A doughnut-type transformer for resistance butt welding comprises an annular core 2 surrounded by transformer sections 3 each having a primary winding 4 and cooled secondary winding 5 connected to contact shoes to be described in more detail hereinafter.

According to the invention the turn 4' and 5' of the primary and the secondary windings 4 and 5 respectively are shaped as sectors in the plane of the transformer cross-section. The turns 4' and 5' are circumferentially disposed so that the turns 4' of the primary winding 4 with their lateral sides are near the lateral sides of each turn 5' of the secondary winding 5. The turn of each winding 4 and 5 has an opening. If arranged circumferentially the turns 4' and 5' therefore with their openings form an annular space. Extending through the annular space is the annular core 2 consisting of two halves in contact along a diametral butt designated 6.

The core 2 is spirally wound from a band of cold-rolled electrical steel. To have the core 2 of a required quality, it is wound from a band 110 mm wide, while to have the core 2 of a required width it is composed of a plurality of individual annular spiral cores 2' (FIG. 2) which are tightened by rod members 7 (FIGS. 1 and 2) arranged in a row relative the transformer axis. The spiral cores 2' are assembled in one core 2 by means of a common shell 8.

The openings in the turns 4' and 5' are such that each radially extending turn has two portions of which that closer to the transformer axis is longer than that closer to the periphery. Thereby the geometric center $O_1$ of the turns with respect to the geometric center $O_2$ (FIG. 3) of the core 2 in the cross-sectional plane through the latter. This results in that the geometric center $O_2$ of the core 2 in its own cross-sectional plane is always farther from the transformer axis than the geometric center $O^1$ of each turn.

Each transformer section 3 (FIG. 1) consists of one turn 5' of the secondary winding 5 and the turns 4' of the primary winding 4 with their lateral sides near the lateral sides of each turn 5'. The turns 4' of the primary winding 4 are rigidly interconnected in series with jumpers 9 extending over the turn 5' of the secondary winding 5.

All the turns are insulated from each other by insulation 10, while each transformer section is sealed with an epoxy compound.

The start of the primary winding 4 of each section 3 is connected in series to the end of the winding 4 of the adjacent section by means of a jumper 11 (FIG. 1).

Circumferentially arranged transformer sections are surrounded by an enclosure 12.

Figure 3:
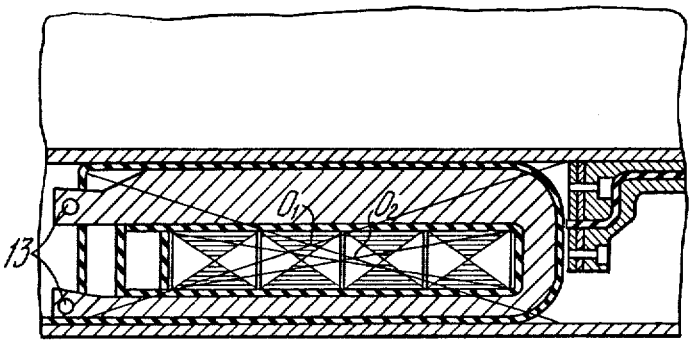
FIG. 3 is a view on the line III—III in FIG. 1 illustrating a turn of the primary winding in a longitudinal section in the transformer of the invention.

Terminals 13 of the turns 4' of the primary winding 4 are connected to power supply (FIGS. 1 and 3).

To convey a welding current from the transformer to the welding zone, there are contact shoes 14 and 15 at the end of each secondary winding 5' (FIG. 2), which in turn are in contact with contact rings 16 and 17 that are common for the whole array of the secondary windings 5'. Attached to the contact rings 16, 17 are flexible bars connected to the contact shoes (not shown) of the welding machine.

Each turn 5' of the secondary winding 5 has a longitudinal (with respect to the transformer axis) passage 18 for a cooling agent, e.g. water, to circulate therethrough.

Figure 2:
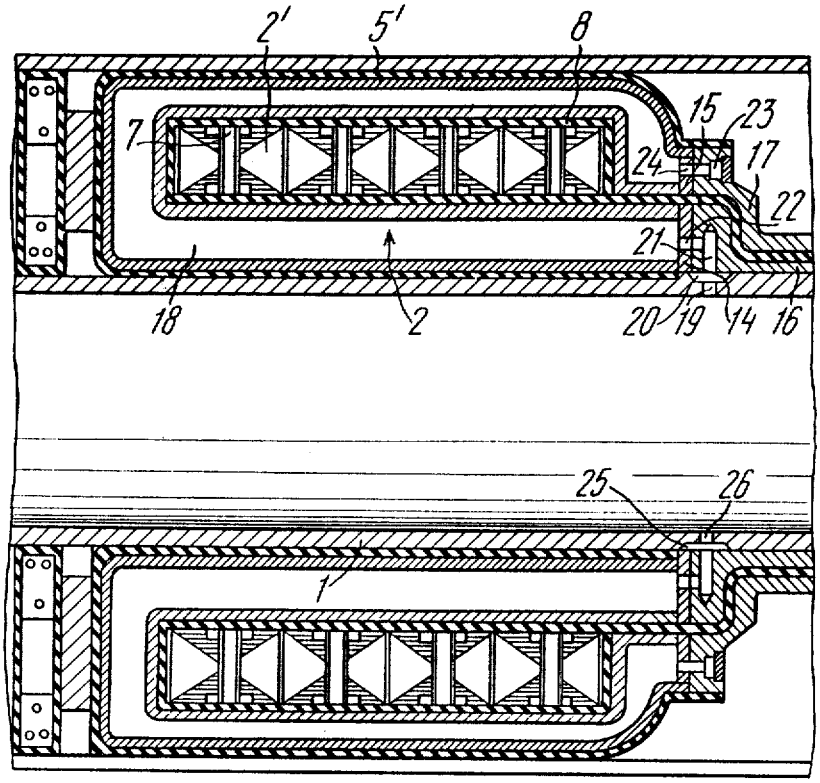
FIG. 2 is a view on the line II—II in FIG. 1 illustrating a turn of the secondary winding in a longitudinal section in the transformer of the invention.
Figure 4:
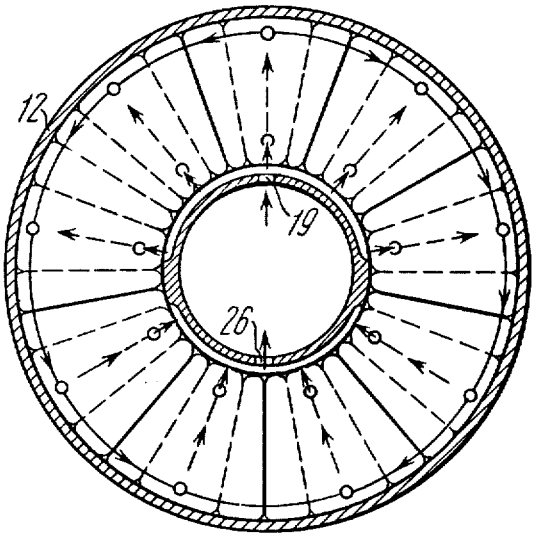
FIG. 4 is a cooling diagram for the transformer of the invention.

One of the contact rings, the inner ring 16 in this instance, has two manifold-type passages for connection to a cooling agent supply line and a cooling agent drain line respectively at one side and communicating with the passages 18 in the secondary windings 5. As can be seen in FIG. 2 cooling water is supplied through a supply line (not shown) and an inlet port 19 to a semiannular slot 20 cut in the surface of the stem 1. From the semiannular slot 20 and through radial bores 21 in the inner contact ring 16 and openings 22 in the contact shoe 14 the water flows to a respective passage 18 of the turn 5' of the secondary winding 5, i.e. the water is supplied to a half of the whole number of turns 5' of the secondary windings 5 (FIG. 4).

The other contact ring, the outer ring 17 in the instance (FIG. 2), has an annular passage 23 communicating with the passage 18 in the turns 5' of the secondary winding 5. Leaving the passage 18 in the turn 5' of the secondary winding 5 and through openings 24 in the contact shoe 15 water flows to the annular passage 23 and now having reached the openings 24 in the contact shoe 15 of the other half of the whole number of the transformer sections 3 (FIG. 4) the water flows into each passage 18 of the turn 5' of the secondary winding 5 of these transformer sections 3. Through the openings 22 in the contact shoe 14 and through the radial bores 21 the water flows to a semiannular slot 25 and farther to discharge through an outlet port 26 communicating with a discharge line (not shown).

As can be inferred from the present disclosure and can be seen in the attached drawings the manifold-type passage intended for connection to a supply line is composed of the inlet port 19, the semiannular slot 20 and radial borings 21, while the manifold-type passage for connection to a discharge line is composed of radial bores 21, semiannular slot 25 and the outlet port 26. Thus, the cooling water is supplied into passage 18 of the turn 5' and is discharged through one and the same contact ring 16.

While the invention has been described herein in terms of the preferred embodiment, numerous variations may be made in the transformer illustrated in the drawings and herein described without departing from the invention as set forth in the appended claims.

What is claimed is:

1. A doughnut-type transformer for resistance butt welding comprising:

an annular core, an array of annularly disposed transformer sections, each including;

a primary winding composed of turns each of which shaped as a sector in the plane of the transformer cross-section, and a cooled secondary winding composed of a turn shaped as a sector in the plane of the transformer cross-section, and placed between the turns of said primary winding so that the turns of said primary winding with their lateral sides are near the lateral sides of each turn of said secondary winding, each turn of both said primary winding and said secondary winding of each said transformer section having an opening forming part of an annular space with said annular core extending therethrough so that the geometric center of each said winding is displaced from the geometric center of said annular core in the cross-sectional plane thereof, the geometric center of said annular core being farther from the transformer axis to level off current density per winding.

2. A doughnut-type transformer as claimed in claim 1, wherein each turn of the secondary winding has a passage for a cooling agent to circulate therethrough, and further comprising two contact rings of which one having two manifold-type passages for connection to a cooling agent supply line and a cooling agent discharge line respectively at one side and communicating with the passages in the secondary windings at the other one, while the other ring having an annular passage communicating with the passages in the secondary windings so as to supply the cooling agent to a half of the whole number of windings and to discharge the same from the other half of the windings.

3. A doughnut-type transformer as claimed in claims 1 or 2, wherein the annular core is composed of a plurality of individual annular spiral metal bands radially tightened by rod members.

* * * * *